United States Patent [19]

Harter

[11] 4,014,148

[45] Mar. 29, 1977

[54] SEALING ELEMENT FOR CORRUGATED PANEL ASSEMBLIES

[75] Inventor: James W. Harter, Independence, Mo.

[73] Assignee: Butler Manufacturing Company, Kansas City, Mo.

[22] Filed: Dec. 17, 1975

[21] Appl. No.: 641,679

[52] U.S. Cl. ..... 52/403; 52/537; 52/DIG. 15

[51] Int. Cl.[2] ..... E04B 1/68

[58] Field of Search ..... 52/403, 537, 90, 618, 52/630; 277/206; 85/DIG. 2

[56] References Cited

UNITED STATES PATENTS

| | | | |
|---|---|---|---|
| 1,512,248 | 10/1924 | Smith | 52/537 |
| 1,705,455 | 3/1929 | Griffiths | 85/DIG. 2 |
| 2,590,264 | 3/1952 | Meyers | 85/DIG. 2 |
| 2,641,340 | 6/1953 | Howe | 52/94 |
| 2,853,330 | 9/1958 | Harry | 52/403 |
| 3,262,236 | 7/1966 | Poyer | 52/90 |
| 3,385,018 | 5/1968 | Harry | 52/403 |
| 3,520,100 | 7/1970 | Webb | 52/630 |
| 3,820,295 | 6/1974 | Folley | 52/630 |

*Primary Examiner*—Price C. Faw, Jr.
*Assistant Examiner*—Henry Raduazo
*Attorney, Agent, or Firm*—Shoemaker and Mattare, Ltd.

[57] ABSTRACT

An element for sealing end voids of corrugated roof panels. The element is shaped and sized to correspond to the shape and size of the corrugated panel end void, and comprises a flexible body having a flange thereon. The flange is grooved for mastic application. An alignment prong cooperates with alignment means in a building structural element so that the element is properly oriented in the end void, and stiffening ribs produce the desired amount of rigidity for the element.

8 Claims, 4 Drawing Figures

SEALING ELEMENT FOR CORRUGATED PANEL ASSEMBLIES

BACKGROUND OF THE INVENTION

The present invention relates to roof panels and, more particularly, to elements for sealing the ends of corrugated roof panels.

Many buildings are constructed with systems of corrugated roof panels forming the roof portion thereof. When connecting such a roof panel system to the building structure, as with any roof panel system, a weathertight seal should be effected between the panel and the building.

When attached to a building structure, the channels of a corrugated roof panel form void spaces between the ends of the corrugation and the building structural elements. These end voids must be suitably closed and sealed to properly seal the roof panel to the building in a weather-tight manner.

Presently used end sealing elements, due to their shapes and/or sizes, require a great deal of material and are often difficult to manufacture. Furthermore, proper alignment and installation of such elements has proven to be difficult and time consuming. Installation of known elements often requires further elements, such as fasteners, to be attached to the end closure to connect the closure to the building structure and to assure proper seating and alignment thereof. Even if they can be properly aligned during installation of the end closure, once installed, the yieldable nature of known and sealing elements often causes them to shift either during the installation of the roof panel, or over a period of time, which may jeopardize the weathertight nature of the seal, thus reducing the effectiveness and the reliability thereof.

SUMMARY OF THE INVENTION

The end closure embodying the teachings of the present invention is easily and quickly manufactured and installed. Once installed, the end closure provides a complete, effective and reliable seal for a corrugation end void. Furthermore, the closure is accurately retained and confined in-place after installation of the rool panel system has been completed.

The end closure of the present invention comprises a unitary, yieldable block shaped to fit the void formed between the end of the corrugation and a building structural element upon which the panel is supported. A flange element is formed on one edge of a central supporting element, or web of the end closure to contact the corrugated panel undersurface to effect a tight seal therewith. The web has a plurality of reinforcing ribs and an alignment prong integrally mounted therewith for cooperation with an alignment hole in the building structural element to align the end closure with a corresponding corrugation and to orient the end closure so that the ribs extend transversely of the corrugation. Thusly oriented, the end closure is self-aligning. That is, when the prong is engaged in the alignment hole, the end closure is automatically strengthened and properly oriented when the roof panel is pushed in place. The ribs are oriented in a manner such that the end closure is rigidized and will therefore provide a complete and reliable weathertight seal.

Like the rest of the end closure, the flange element is unitary, but comprises several sections which are on the top and sides of the web, and flex so that when the end closure is positioned within a corrugation end void, that closure is pressed into a shape which assures the complete and continued sealing of the void.

The end closure embodying the present invention therefore has several advantages over those end closures of the prior art. For example, the flange and web configuration of the end closure greatly reduces the amount of material required for this end closure from that amount of material required for known end closures. Furthermore, the structure of the end closure is amenable to injection molding, thus producing an efficiently and easily manufactured element. The reinforcing ribs rigidize the end closure to prevent it from unduly yielding and jeopardizing the weathertightness of the seal. The projecting alignment prong permits easy and sure positioning of the end closure without requiring additional parts, such as fasteners, or the like. This easy and sure installation reduces the overall cost as well as the field labor time required to install the end closures.

Objects of the Invention

It is therefore a main object of the present invention to provide an end closure which is easily and quickly manufactured and installed.

Another object of the present invention is to provide an end closure which is self-aligning.

A further object of the present invention is to provide an end closure which is deformable to accurately conform to the shape of the corrugation end void.

It is yet another object of the present invention to rigidize an end closure to insure complete and reliable sealing of a corrugation end void.

These together with other objects and advantages which will become subsequently apparent reside in the details of construction and operation as more fully hereinafter described and claimed, reference being had to the accompanying drawings forming part hereof, wherein like numerals refer to like parts throughout.

DETAILED DESCRIPTION OF THE PREFERRED EMBODIMENT

Figure 1:
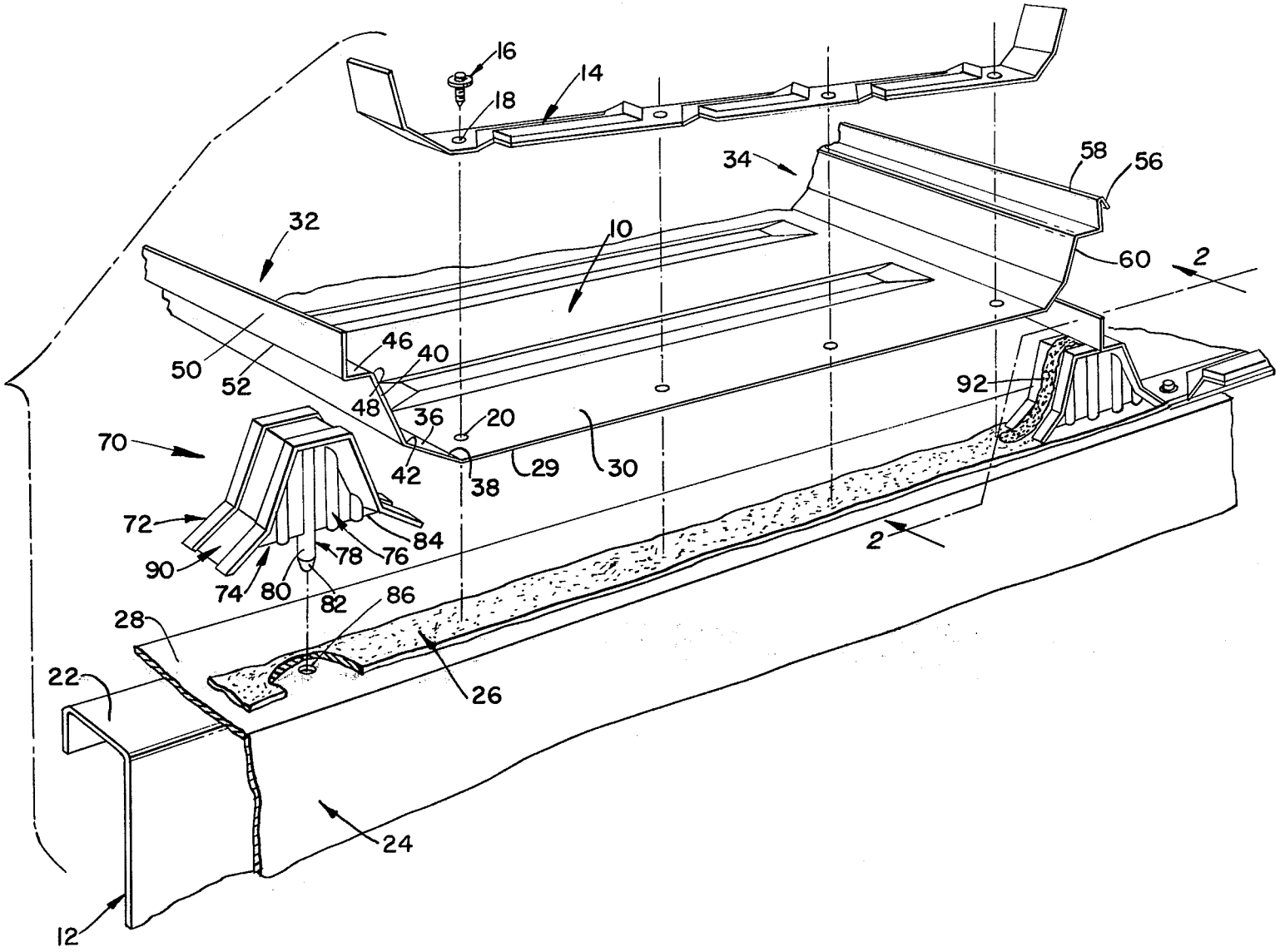
FIG. 1 is an exploded perspective view of a roofing construction using an end closure device embodying the teachings of the present invention.

As shown in FIG. 1, a corrugated roof panel 10 is mounted on a building structure 12. A panel strap 14 is secured to the corrugated panel 10 and to the building structural member 12 by fastening means 16, such as tapping screws, or the like, fitting through aligned holes 18 and 20 in the panel strap 14 and the corrugated roof panel 10 respectively, and into upper face 22 of building structural member 12. An eave gutter or trim 24 can also be secured to the building structural member between the roof panel 10 and upper face 22 of the structural member 12. A mastic strip 26 is also positioned between upper face 28 of the element 24 and lower face 29 of panel 10 to further insure proper weatherseal of the roof panel 10 to the building structural member 12.

Figure 2:
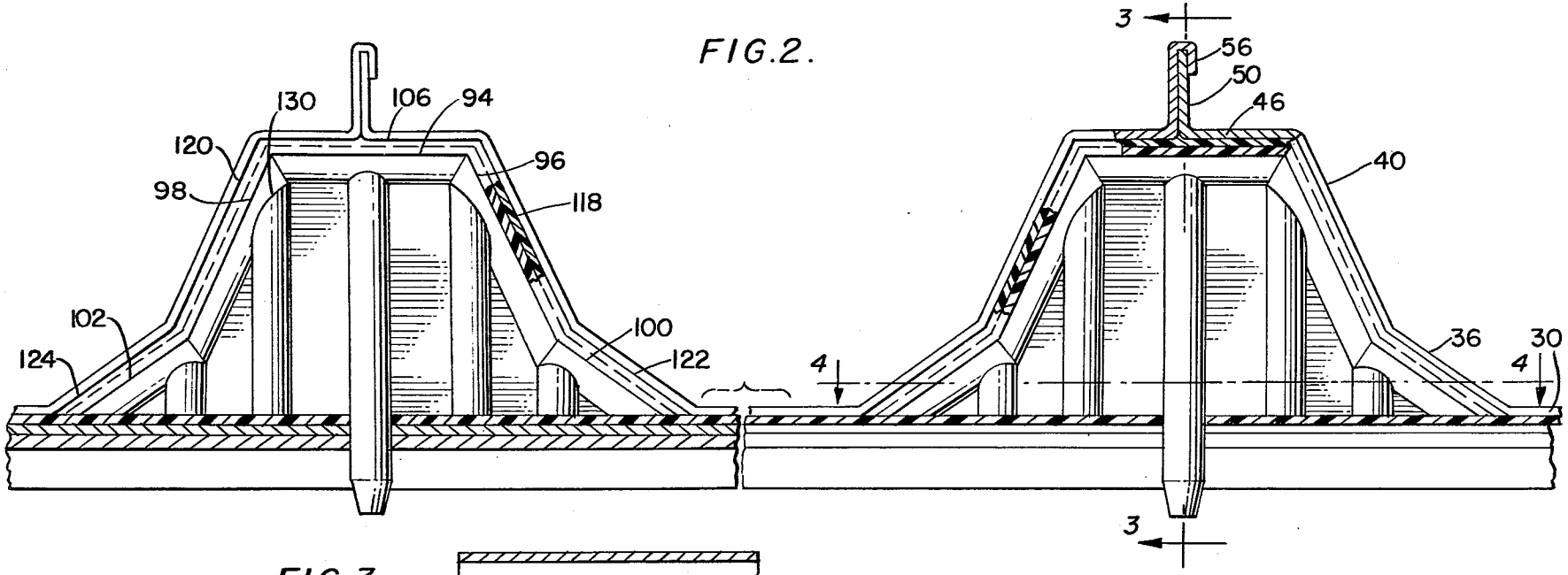
FIG. 2 is an elevation view taken substantially along line 2—2 of FIG. 1 showing two end closure devices installed.

As shown in FIG. 1, the roof panel 10 comprises a flat band or lower face 30 bounded by stepped panels 32 and 34. Panel 32 comprises a first face 36 connected to lower face 30 along bend line 38 and oriented at an obtuse angle thereto, and a connecting face 40 connected to first face 36 along a bend line 42 and connecting to one edge of an upper face 46 along a bend 48. The stepped panel 32 also comprises an upright element 50 connected to upper face 46 along a bend line 52. The stepped panel 34 is similar to the stepped panel 32, and further includes a hooking lip 56 connected to the uppermost edge of upright element 50 along a bend line 58. The hooking lip 56 cooperates with the upright element 50 of a next adjacent roof panel to form a standing seam to serially connect the roof panel 10 to form a corrugated roof. The standing seams are best shown in FIG. 2.

When the roof panels 10 are serially connected, the plurality of corrugations are formed. Each corrugation has an end void formed between the corrugation inner surface 60 and the element 24 adjacent each end of each corrugation. Unless these end voids are suitably closed, the roof structure will not be weathertight and sealed.

A sealing element, or end closure device 70 is shown in FIG. 1 positioned between corrugation inner surface 60 and element 24 adjacent the end of roof panel 10. The end closure device 70 comprises a flange element 72 integrally connected to a web, or supporting member 74. A plurality of reinforcing ribs 76 for stiffening the member 74 are integrally formed with the supporting member 74 and an alignment prong 78 is also integrally formed with the supporting member 74. The alignment prong 78 also forms a reinforcing rib and comprises a projection 80 having thereon a lower tip 82 which extends beneath bottom 84 of support member 74. An aligning hole 86 extends through element 24 and structural member 12 to cooperate with projection 80 of the alignment prong 78 to orient end closure device 70 adjacent the end of a corrugation of the roof panel 10. The alignment prong therefore can serve a dual purpose of reinforcing and aligning the member. A groove 90 is defined on the outer surface of flange 72 for receiving mastic material 92 (gungrade) to further seal the roof member 10 to the building structural member 12. The tip 82 serves to ease the alignment process by guiding the projection 80 into hole 86. The end closure device 70 is pressed down into mastic strip 26.

It is here noted that the end closure device 70 is molded as a single, integral unit. However, for the sake of clarity, that end closure device will be described in terms of sides, tops and the like. In this respect, it is also noted that expressions such as "top," "bottom," and the like are terms of convenience and not of limitation, as the same principles are involved regardless of whether the structure is horizontal, vertical, or inclined.

Figure 3:
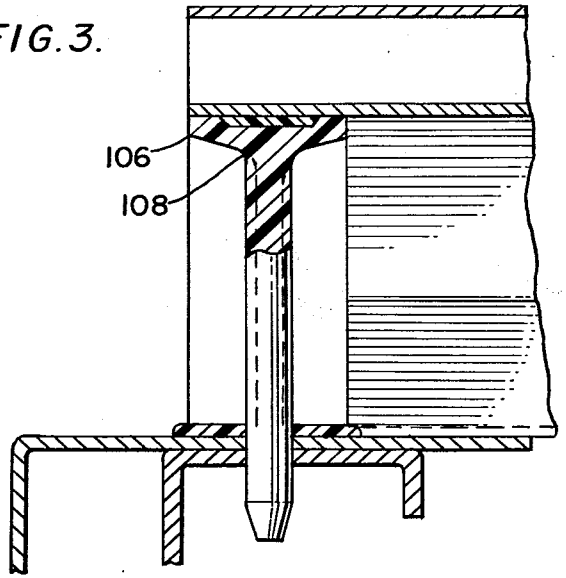
FIG. 3 is a sectional view taken along line 3—3 of FIG. 2.
Figure 4:
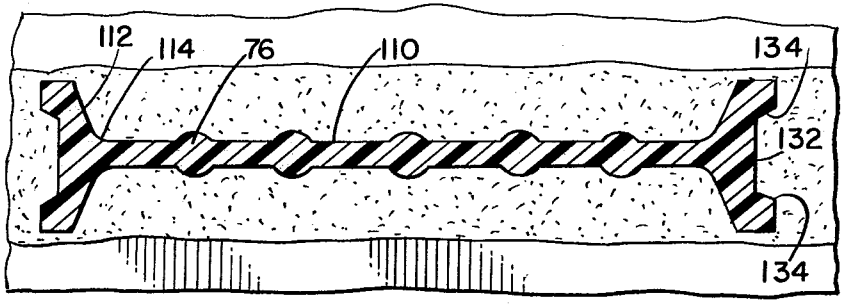
FIG. 4 is a sectional view taken along line 4—4 of FIG. 2.

As shown in FIG. 2, supporting member 74 comprises a top 94 having side portions 96 and 98 connected at opposite ends thereof and depending therefrom. A pair of wing elements 100 and 102 are connected to the side portions at the ends thereof which are remote from the top 94. As shown in FIG. 3, the top of the supporting member is connected to a flange top 106 along fillet connections 108. As shown in FIG. 4, the ribs 76 are thicker than connecting portions 110 extending therebetween, and connecting portions 110 are connected to the inner surface 112 of the flange along fillets 114. Therefore, the supporting member 74 includes the walled portion 110 which is thin relative to the reinforcing ribs 76 with the flange element 72 forming a panel engaging flange. The prong 78 thus forms an alignment element in the body which cooperates with the hole 86 which forms an alignment element in the building to align the closure member relative to the panel 10.

As shown in FIG. 2, the flange 90 comprises a top 106 on top 94 of the supporting member 74, and side sections 118 and 120 connected thereto and depending therefrom. Wing sections 122 and 124 are connected to the lower end of the side sections 118 and 120 respectively, and the side sections and wing sections are positioned on the respective side portions and wing elements of the supporting member. As shown in FIGS. 2 and 3, the ribs and alignment prong intersect the inner surface 112 of the flange element to form crescent shaped intersection lines 130 and the fillet connections 108 and 114.

As shown in FIGS. 1 and 4, mastic groove 90 comprises a bottom surface 132 and sloping slide surfaces 134 which retain mastic 92 in the configuration shown in FIG. 1 until roof panel 10 is firmly pressed thereagainst.

The wing elements, the side elements and the top element of the end closure device 70 are shaped to conform with the sinous shape of corrugation inner surface 60 adjacent the end of the corrugation. The closure device 70 is formed of a yieldable material, such as an elastomer or plastic material, so that when that closure device is oriented in and end void defined between a corrugation formed by the serially connected roof panels 10 and the building structural member 12, that end closure device will properly conform to the size and shape of that corrugation.

Therefore, once the element 24 is properly oriented on the structural member 12 and the mastic strip 26 placed on upper face 28, thereof, alignment hole 86 can be defined for receiving the projection 80 of the end closure device 70. Once oriented by the cooperation of projection 80 and aligning hole 86, the end closure device will remain in place while the roof panels 10 are serially connected along the standing seams to form the roof panel system. Prior to placing the roof panels 10 against the closure devices 70, mastic 92 is placed in mastic groove 90. The roof panels are then placed against the end closure devices, the panel straps 14 oriented thereon, and fastening means 16 tapped into structural member 12 to fasten the roof panel system in place.

When the roof panels are pushed into place, the alignment projection 80 cooperates with aligning hole 86 to assure proper orientation of the end closure device 70 in the corrugation end void, and once in place, the end closure device is securely confined in that end void.

It is noted that the end closure device can be manufactured of either rubber or ethylene vinyl acetate (E.V.A.), and can also be used in various locations requiring specific adaptations, such as roof openings or ventilators.

It is also noted that the reinforcing ribs 76, along with the alignment prong 78, serve to rigidize the supporting member and prevent it from being deformed, either during installation, or thereafter which would jeapordize the weathertightness of the seal. Thus, while yieldable, the end closure device 70 has sufficient stiffness to maintain a weathertight and reliable seal in the end void of the corrugations. It is also noted that because the alignment prong 78 is easily fixed into aligning hole 86, orientation and installation of the end closure device 70 is easy and rapid. The single-piece construction of the end closure device further facilitates injection-type molding which makes manufacture of the end closure devices simple and efficient.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by those claims.

What is claimed is:

1. A sealing element for use with corrugated roof panels to seal voids between the roof panels and a building structural member adjacent the ends of the panel corrugations, comprising:

a support member which approximately corresponds in shape and size to the transverse cross-sectional shape and size of one of the corrugation ends, which includes a plurality of reinforcing ribs integral therewith and an alignment element integral therewith for cooperation with alignment means in the building structural member to align said support member in the end of a panel corrugation so that said reinforcing ribs and said alignment element are oriented transversely of the corrugation; and a flange element on said support member for engaging the corrugation to close and seal the void between the roof panel and the corrugation end.

2. The sealing element of claim 1 further including a groove defined in said flange element which receives mastic material for sealing the element to an underside of a roof panel.

3. The sealing element of claim 1 wherein said yieldable material is rubber.

4. The sealing element of claim 1 wherein said yieldable material is ethylene vinyl acetate.

5. The sealing element of claim 1 wherein the sealing element is formed as a single piece of injection moulding.

6. The sealing element of claim 1 wherein said alignment element is located at the longitudinal center of said support member.

7. A sealing element for use with corrugated roof panels to seal voids between the roof panels and a building structural member adjacent the ends of the panel corrugations, comprising:

a support member which corresponds in shape and size to the transverse cross-sectional shape and size of one of the corrugation ends, and has a top, a bottom and side sections, a plurality of reinforcing ribs integral therewith, and an alignment element integral therewith for cooperation with alignment means in the building structural member to align said support member in the end of a panel corrugation so that said reinforcing ribs and said alignment element are oriented transversely of the corrugation; and a flange element on said support member for engaging the corrugation to seal and close the end thereof, said flange element including a top section on the top of said support member, a pair of side sections on the sides of said support member and which are connected at one end to one end of said top section and depend therefrom, and a pair of wing sections each connected to the other end of each of said side sections and extending outwardly therefrom, said support member and said flange element being yieldable so that the sealing element flexes when it is positioned in the end void of the corrugation between the corrugation and the building structural element for closing and sealing the void between the roof panel and the corrugation end.

8. A sealing element for use with corrugated roof panels to seal voids between the roof panels and a building structural member adjacent the ends of the panel corrugations, comprising:

a support member having a generally transverse cross-section which is sized and shaped to correspond to the transverse cross-sectional configuration of a roof panel corrugation, said support member including a top, a bottom and side portions, said side portions each having a first portion connected to said top portion at one end and a second portion angularly connected to the other end of said first portion and depending therefrom, a plurality of reinforcing ribs integral with said support member, an alignment prong integral with said support member and projecting from the bottom thereof for engaging an alignment hole in said building structural member for positioning said support member in the void adjacent the end of the panel corrugation with said ribs and said alignment prong oriented essentially vertically, a flange member integral with said support member and including a top section on said support member top section, a first side section on each of said support member first portions and connected at one end to said top section, and a pair of wing sections each angularly connected to the other end of said first portions, said flange member having defined therein a groove for receiving adhesive material; and said support member and flange being yieldable so that said support member and flange flex to conform to the shape and size of the corrugation cross section adjacent an end thereof for closing and sealing the void between the corrugation end and the building support member.

* * * * *